US009804525B2

(12) United States Patent
Kotani et al.

(10) Patent No.: US 9,804,525 B2
(45) Date of Patent: Oct. 31, 2017

(54) DEVELOPING DEVICE AND IMAGE FORMING APPARATUS THAT DETECT TONER DENSITY

(71) Applicant: KYOCERA Document Solutions Inc., Osaka (JP)

(72) Inventors: Yukiko Kotani, Osaka (JP); Kei Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 3 days.

(21) Appl. No.: 15/209,279

(22) Filed: Jul. 13, 2016

(65) Prior Publication Data

US 2017/0023877 A1 Jan. 26, 2017

(30) Foreign Application Priority Data

Jul. 24, 2015 (JP) ..... 2015-147232

(51) Int. Cl.
*G03G 15/08* (2006.01)
*G03G 15/01* (2006.01)

(52) U.S. Cl.
CPC ..... *G03G 15/0831* (2013.01); *G03G 15/0126* (2013.01); *G03G 15/0889* (2013.01)

(58) Field of Classification Search
None
See application file for complete search history.

(56) References Cited

U.S. PATENT DOCUMENTS

2006/0127111 A1 6/2006 Komori ..... 399/30
2007/0196116 A1* 8/2007 Watanabe ..... G03G 15/0853 399/30
2012/0177412 A1* 7/2012 Watanabe ..... G03G 15/0189 399/256
2014/0270817 A1 9/2014 Ikebata ..... 399/27

FOREIGN PATENT DOCUMENTS

JP 2014-240876 A 12/2004
JP 2006/171175 A 6/2006
JP 2006-171176 A 6/2006
JP 2012-168232 A 9/2012
JP 2014-174495 A 9/2014

* cited by examiner

*Primary Examiner* — Thomas Giampaolo, II
(74) *Attorney, Agent, or Firm* — Stein IP, LLC

(57) ABSTRACT

A developing device includes N number of containers, N number of conveying members, N number of first sensors, stirring portions, a switching unit, and a control unit. The N number of conveying members stir and convey respective developers inside the N number of containers. The N number of first sensors are located at the N number of containers to detect toners remaining amount inside of the N number of containers. The stirring portions are located at the respective N number of conveying members to stir the developers at detecting regions opposed to detecting surfaces of the N number of first sensors by rotations of the N number of conveying members. The switching unit selects any one of outputs of the N number of first sensors to output. The control unit receives the selected output to detect the remaining amounts of the developers inside the N number of containers.

5 Claims, 6 Drawing Sheets

DEVELOPING DEVICE AND IMAGE FORMING APPARATUS THAT DETECT TONER DENSITY

INCORPORATION BY REFERENCE

This application is based upon, and claims the benefit of priority from, corresponding Japanese Patent Application No. 2015-147232 filed in the Japan Patent Office on Jul. 24, 2015, the entire contents of which are incorporated herein by reference.

BACKGROUND

Unless otherwise indicated herein, the description in this section is not prior art to the claims in this application and is not admitted to be prior art by inclusion in this section.

Some typical electrophotographic-method image forming apparatuses use a two-component-development-method developer. The two-component-development-method developer is made of magnetic powder, which is referred to as a magnetic carrier, and toner, which is colorant. At a development process when forming an image, since only the toner is consumed, the toner is supplied to the developer, and then the magnetic powder and the toner are stirred. Thus, in order to replenish the toner with an amount consumed at the development process, a toner density detecting sensor, which measures toner density in the developer, is equipped with an image forming apparatus. At a color image forming apparatus, for example, since cyan, magenta, yellow, and black toners are used for development, four toner density detecting sensors are used to detect respective remaining amounts of four color toners.

SUMMARY

A developing device according to one aspect of the disclosure includes N (N is an integer equal to or greater than two) number of containers, N number of conveying members, N number of first sensors, stirring portions, a switching unit, and a control unit. The N number of containers each house a developer including a toner. The N number of conveying members stir and convey the respective developers inside the N number of containers. The N number of first sensors are located at the N number of containers each to detect a toner remaining amount inside each of the N number of containers. The stirring portions are located at the respective N number of conveying members to stir the developers at detecting regions opposed to detecting surfaces of the N number of first sensors by rotations of the N number of conveying members. The switching unit selects any one of outputs of the N number of first sensors to output. The control unit receives the selected output to detect the remaining amounts of the developers inside the N number of containers.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
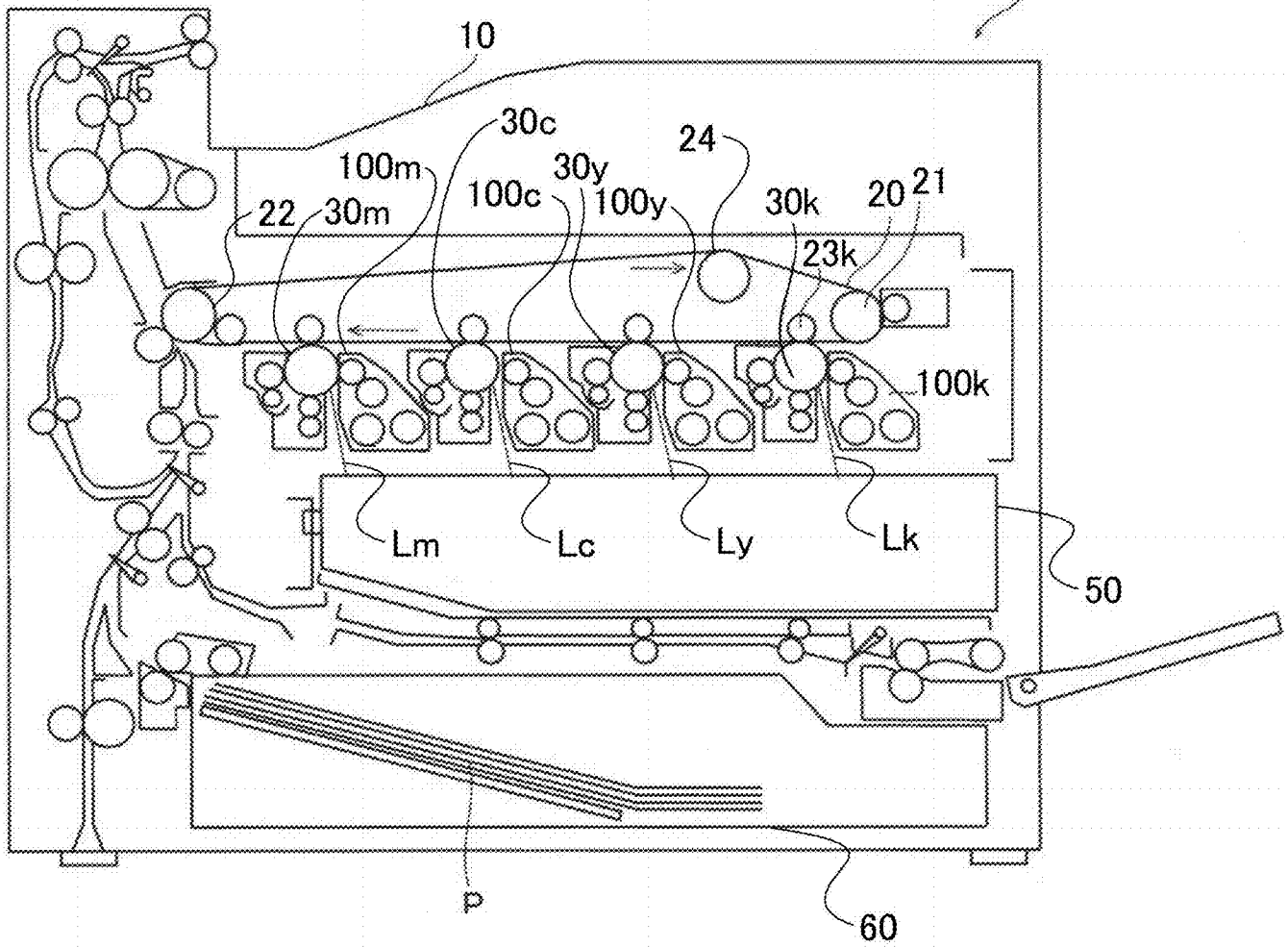
FIG. 1 illustrates a cross section of an overall configuration of an image forming apparatus including a developing device according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a configuration to execute the disclosure (hereinafter referred to as "embodiment") with reference to the drawings.

FIG. 1 illustrates a cross section of an overall configuration of an image forming apparatus 1 including a developing device according to one embodiment of the disclosure. The image forming apparatus 1 according to the embodiment is a tandem-type color printer. The image forming apparatus 1 includes a housing 10 where photoreceptor drums (image carriers) 30*m*, 30*c*, 30*y*, and 30*k* are arranged in a row corresponding to respective colors: magenta, cyan, yellow, and black. Adjacent to the photoreceptor drums 30*m*, 30*c*, 30*y*, and 30*k*, developing devices 100*m*, 100*c*, 100*y*, and 100*k* are arranged respectively.

To the photoreceptor drums 30*m*, 30*c*, 30*y*, and 30*k*, laser beams Lm, Lc, Ly, and Lk for the respective colors are irradiated from an exposure unit 50. This irradiation forms electrostatic latent images on the photoreceptor drums 30*m*, 30*c*, 30*y*, and 30*k*. The developing devices 100*m*, 100*c*, 100*y*, and 100*k*, while stirring toner, attach the toner to the electrostatic latent images formed on surfaces of the photoreceptor drums 30*m*, 30*c*, 30*y*, and 30*k*. This completes a development process to form toner images of the respective colors on the surfaces of the photoreceptor drums 30*m*, 30*c*, 30*y*, and 30*k*.

The image forming apparatus 1 includes an endless intermediate transfer belt 20. The intermediate transfer belt 20 is stretched to a tension roller 24, a drive roller 22, and a driven roller 21. The intermediate transfer belt 20 is driven in cycles by rotation of the drive roller 22.

For example, a black toner image on the photoreceptor drum 30*k* is primarily transferred to the intermediate transfer belt 20 such that the photoreceptor drum 30*k* and a primary transfer roller 23*k* sandwich the intermediate transfer belt 20 to drive the intermediate transfer belt 20 in cycles. In this respect, the same applies to the three colors: cyan, yellow, and black. On a surface of the intermediate transfer belt 20, the primary transfers mutually superimposed at a predetermined timing form a full-color toner image. Afterward, the full-color toner image is secondarily transferred to a printing paper sheet P supplied from a sheet feed cassette 60 to be fixed to the printing paper sheet P at a well-known fixing process.

Figure 2:
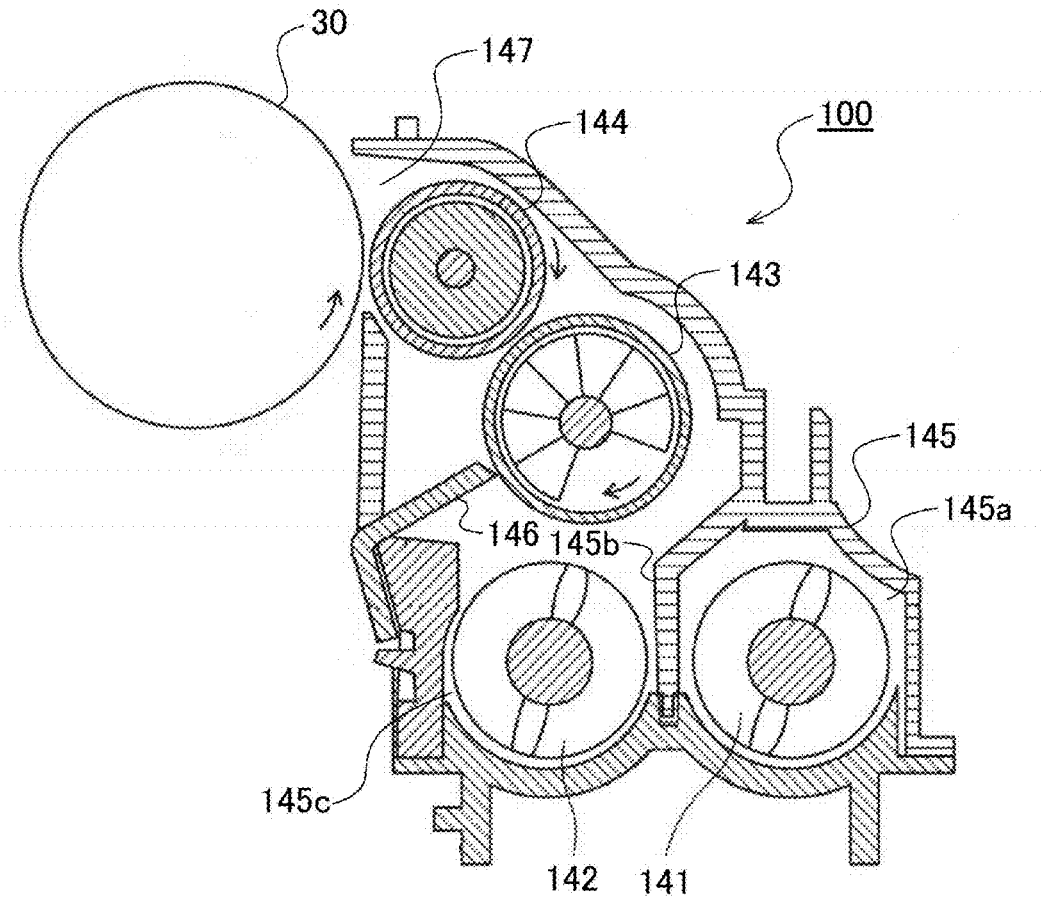
FIG. 2 illustrates a cross section of a side surface of a construction of the developing device according to the one embodiment.

FIG. 2 illustrates a cross section of a side surface of a construction of the developing device 100*k* according to the one embodiment. The developing devices 100*m*, 100*c*, and 100*y* have configurations identical to the developing device 100*k*, and are simply referred to as a developing device 100 (see FIG. 2). The developing device 100 includes a developing roller (a developer support) 144, a magnetic roller 143, a regulating blade 146, two conveying members 141 and 142, and a container 145.

The container 145 constitutes an outside of the developing device 100. The container 145 includes a lower portion where a partition portion 145*b* is located. The partition portion 145*b* separates an inside of the container 145 into a first conveying chamber 145*a* and a second conveying chamber 145*c*. The first conveying chamber 145*a* and the second conveying chamber 145*c*, which cylindrically extend in a direction perpendicular to FIG. 2, house two-component developer (simply referred to as developer) made of magnetic carrier and black toner. At the first conveying chamber 145*a* and the second conveying chamber 145*c*, the conveying members 141 and 142 are rotatably arranged respectively to stir the developer.

The container 145 further, rotatably holds the magnetic roller 143 and the developing roller 144. At the container 145, an opening 147, which exposes the developing roller 144 to a photoreceptor drum 30 (30*k*), is formed. The two conveying members 141 and 142, while stirring the developer inside the first conveying chamber 145*a* and the second conveying chamber 145*c* respectively, cyclically move the developer.

The conveying member 142, as a magnetic brush, supplies electrostatic-charged developer to the magnetic roller 143. The regulating blade 146 adjusts the magnetic brush at a predetermined height preliminarily set. The magnetic roller 143 supplies only the toner from the developer to the developing roller 144 in a well-known method. The developing roller 144 attaches the toner to a latent image formed on a surface of the photoreceptor drum 30 to form a visible image of an inverted image on a surface of the photoreceptor drum 30.

Figure 3A:
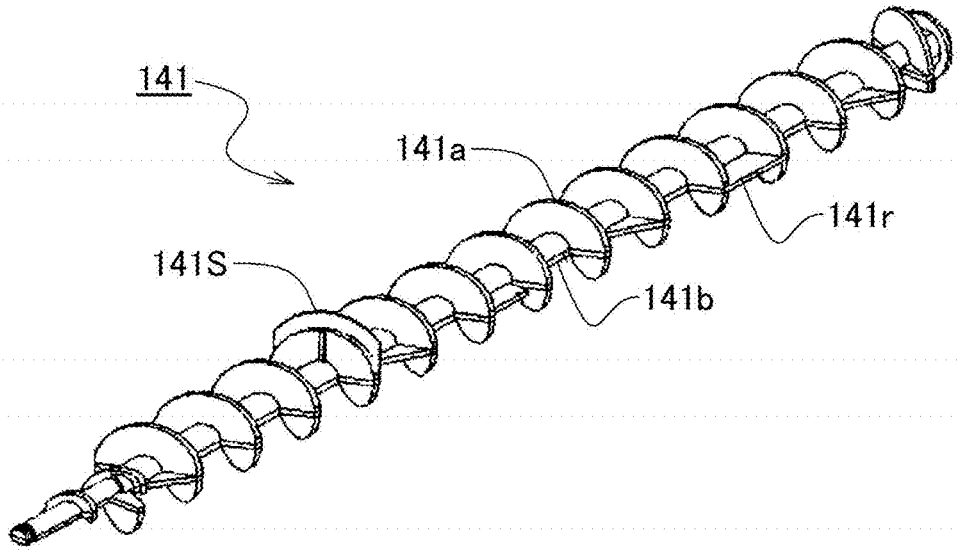
FIGS. 3A and 3B illustrate a conveying member that the developing device according to the one embodiment has.
Figure 3B:
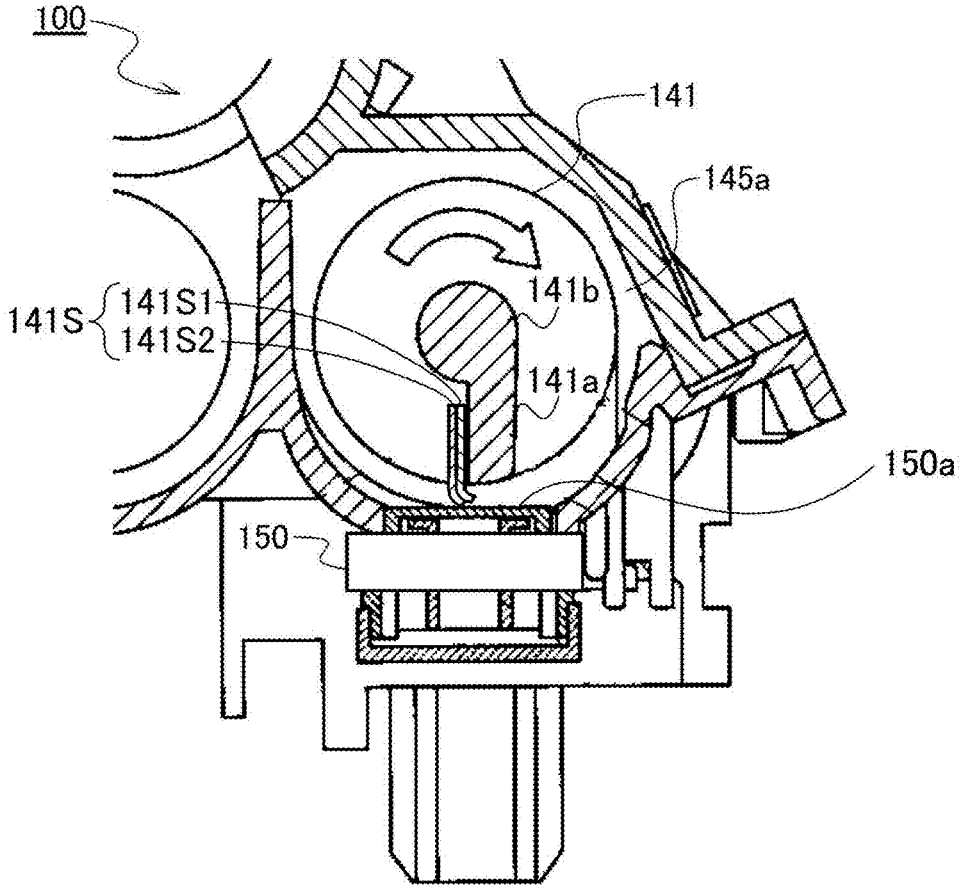

FIG. 3A obliquely illustrates the conveying member 141 of the developing device 100 according to the one embodiment. FIG. 3B illustrates a cross section of a side surface illustrating equipping states of the conveying member 141 and a density sensor 150 of the developing device 100 according to the one embodiment. The conveying member 141, which includes a rotation shaft 141*b*, a spiral blade 141*a*, and a rib 141*r*, is integrally constituted with them. The rotation shaft 141*b* is rotatably driven by a motor (not illustrated). The spiral blade 141*a* is formed in a spiral pattern with a constant pitch in an axial direction of the rotation shaft 141*b*. The rib 141*r* is a member to adjust conveying speed of the developer.

The conveying member 141 further, includes a scraper 141S at a region opposed to the density sensor 150 (referred to as a detecting region). The scraper 141S, which includes a nonwoven fabric 141S1 and a polyethylene sheet 141S2 having identical shapes, is bonded to the spiral blade 141*a* with an adhesive layer (not illustrated). The scraper 141S has a length to be able to clean a detecting surface 150*a* when the conveying member 141 rotates.

The conveying member 141, while stirring the developer by rotating, can remove the developer being deposited on the detecting surface 150*a* by the scraper 141S to reduce accumulation of the developer. This can reduce misdetections (errors) due to the accumulation of the developer (for example, attachment or deposition to the detecting surface 150*a*) at the detecting region. The scraper 141S is also referred to as a stirring portion.

Figure 4:
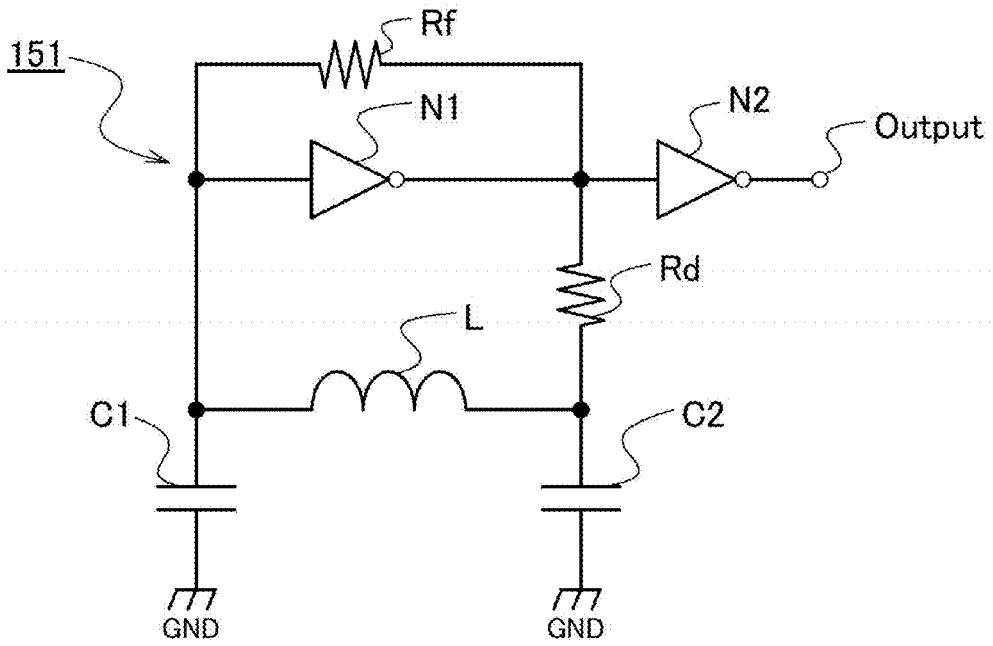
FIG. 4 illustrates a NAND oscillator circuit of a density sensor that the developing device according to the one embodiment has.

FIG. 4 illustrates a NAND oscillator circuit 151 of the density sensor 150 that the developing device 100 according to the one embodiment has. The density sensor 150 includes the NAND oscillator circuit 151 using a NAND gate (for example, 74HC00). The NAND oscillator circuit 151 includes two inverters N1 and N2, two resistors Rf and Rd, a coil L, and two capacitors C1 and C2. The two inverters N1 and N2 are connected in series. The inverter N2 has an output that is an output of the NAND oscillator circuit 151 (an output of the density sensor 150).

The NAND oscillator circuit 151 is constituted of connections as follows. To the inverter N1, the resistor Rf is connected in parallel. To the inverter N1, further, a series circuit of the resistor Rd and the coil L is connected in parallel. The resistor Rd and the coil L have a connecting point that is grounded via a capacitor C2. The coil L and an input of the inverter N1 have a connecting point that is grounded via a capacitor C1. The NAND oscillator circuit 151 causes the inverter N1 to repeat inversion of a logical value together with charge and discharge of the two capacitors C1 and C2 as well known, to oscillate.

The coil L is arranged so that an inductance changes corresponding to the toner density in the developer on the detecting surface 150*a*. Specifically, the coil L is arranged so that magnetic flux generated by the coil L passes through the developer on the detecting surface 150*a*. At the coil L, since as the toner density increases, proportion of the toner, where magnetic against the magnetic carrier does not pass through, increases, magnetic permeability decreases to decrease the inductance. On the other hand, at the coil L, since as the toner density decreases, the proportion of the toner, where magnetic against the magnetic carrier does not pass through, decreases, the magnetic permeability increases to increase the inductance.

Thus, at the density sensor 150, resonant frequency of the NAND oscillator circuit 151 changes corresponding to change of the inductance of the coil L. Specifically, if the toner density increases to decrease the inductance of the coil L, the resonant frequency increase, and if the toner density decreases to increase the inductance of the coil L, the resonant frequency decreases. The density sensor 150 is referred to as a first sensor.

Figure 5:
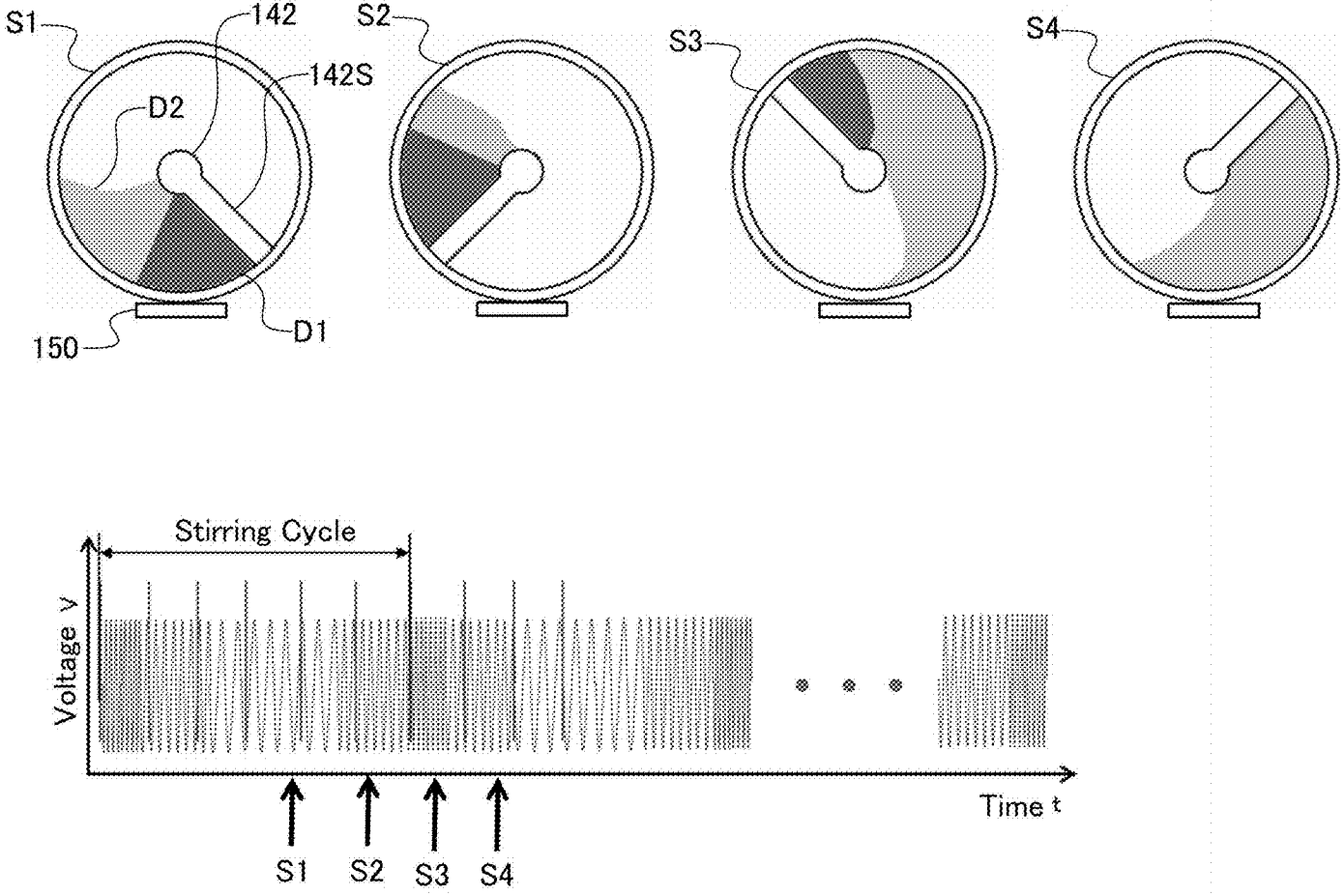
FIG. 5 illustrates a relation between a rotation angle of the conveying member and a detecting state of the density sensor that the developing device according to the one embodiment has.

FIG. 5 illustrates a relation between a rotation angle of the conveying member 141 and a detecting state of the density sensor 150 that the developing device 100 according to the one embodiment has. FIG. 5 illustrates the conveying member 141 in four states S1 to S4 with different rotation angles and waveforms at the respective states detected by the density sensor 150. The four states S1 to S4 illustrate states of the developer stirred by the scraper 141S of the conveying member 141. In the four states S1 to S4, developer states D1 and D2 (simply referred to as developers D1 and D2) are also illustrated. The developer state D1 illustrates a state of relatively dense developer in a state being pressed by the scraper 141S. The developer state D2 illustrates a state of relatively low-density developer being deposited.

In the state S1, the relatively dense developer D1 is detected by the density sensor 150. The developer D1 has higher magnetic permeability than a magnetic permeability of air to decrease a detecting frequency. In the state S2, the relatively dense developer D1 is separating from the density sensor 150 to increase the detecting frequency such that the magnetic permeability of air becomes gradually dominant. In the state S3, the relatively dense developer D1 separates significantly from the density sensor 150 to increase further the detecting frequency. In the state S4, the relatively low-density developer D2 starts flowing into an upper side of the density sensor 150 to shift the detecting frequency to decrease.

The present inventor found that the detecting frequency of the density sensor 150 thus changes at a constant stirring cycle. Furthermore, the present inventor also found that since in the state S1, the relatively dense developer D1 is detected by the density sensor 150, the state S1 has an angle where the change of the magnetic permeability of the developer can be most remarkably detected.

Thus, the present inventor found that the detecting frequency of the density sensor 150 has following features.

Feature 1: The detecting frequency of the density sensor 150 decreases by reduction of the toner.

Feature 2: The detecting frequency of the density sensor 150 changes at the constant stirring cycle.

Considering Feature 1 and Feature 2, the reduction of the toner density can be detected by whether or not the detected lowest frequency within the stirring cycle becomes lower than a preliminarily set threshold value. The frequency can be detected, for example, by using a counter, as a count value of pulses at regular time intervals within the stirring cycle.

Figure 6:
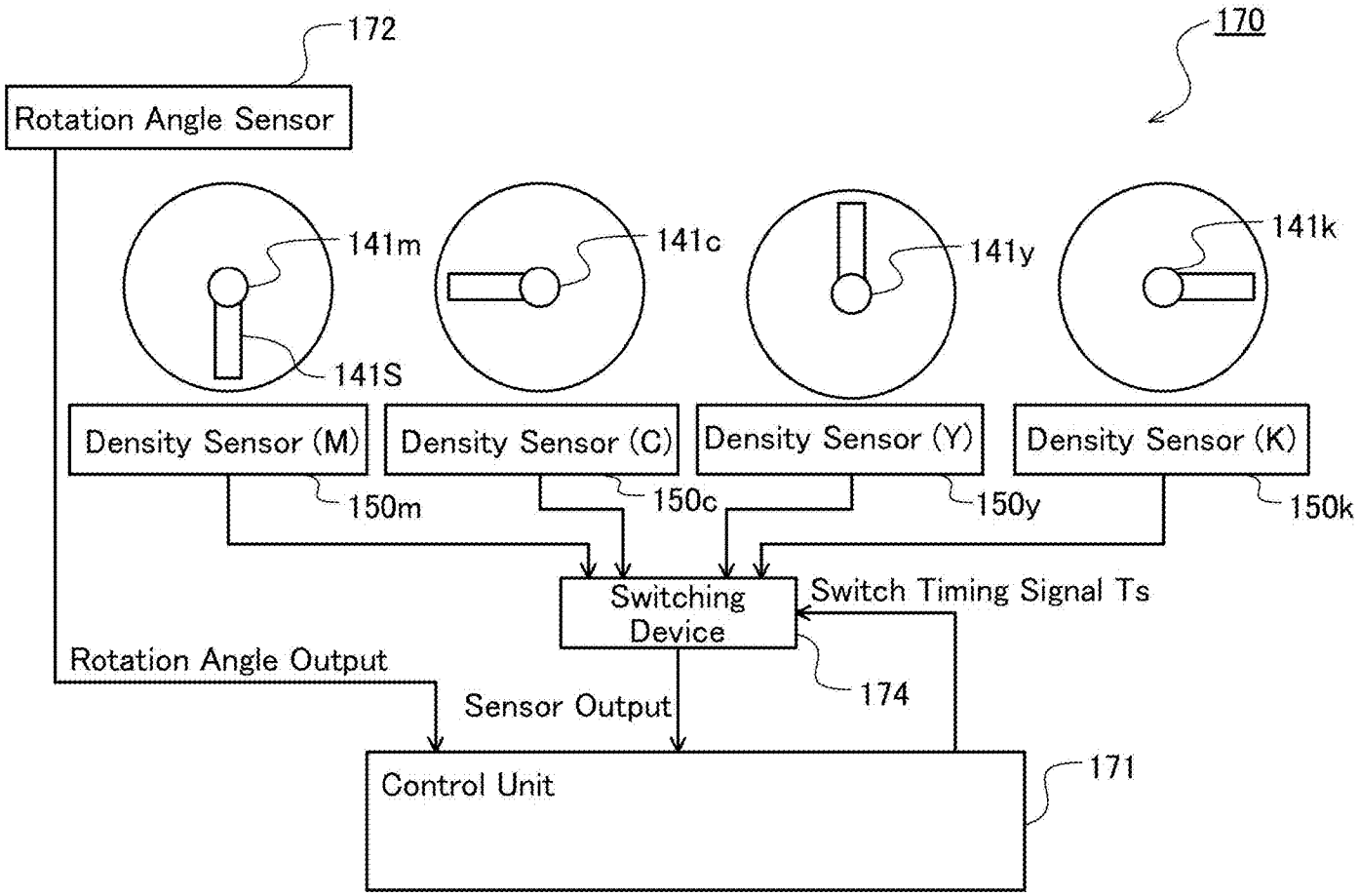
FIG. 6 illustrates a toner density detecting system of the developing device according to the one embodiment.

FIG. 6 illustrates a toner density detecting system 170 of the developing devices 100*m*, 100*c*, 100*y*, and 100*k* according to the one embodiment. The toner density detecting system 170 includes a control unit 171, a rotation angle sensor 172, four density sensors 150*m*, 150*c*, 150*y*, and 150*k*, and a switching device 174. The rotation angle sensor 172 is also referred to as a second sensor. The rotation angle sensor 172 can use, for example, a rotary encoder or a rotatable switch to measure a rotation angle, which is an angle of a conveying member 141*m* with respect to the detecting surface 150*a* of the developing device 100*m*. The four density sensors 150*m*, 150*c*, 150*y*, and 150*k* have identical configurations to detect toner densities of magenta, cyan, yellow, and black respectively as described above.

Four conveying members 141*m*, 141*c*, 141*y*, and 141*k* stir the developers of magenta, cyan, yellow, and black respectively. The conveying members 141*m*, 141*c*, 141*y*, and 141*k*, while maintaining following relations, are synchronously driven. Specifically, this is achievable by driving the conveying members 141*m*, 141*c*, 141*y*, and 141*k* by, for example, a gear drive (not illustrated) or a chain drive.

The four conveying members 141*m*, 141*c*, 141*y*, and 141*k* have phase differences at regular intervals (or angle differences at preliminarily set unequal intervals), and in the embodiment, have mutually following phase relationships (phase differences). That is, the conveying member 141*c* puts the phase to 90 degrees in a clockwise direction with respect to the conveying member 141*m*. The conveying member 141*y* puts the phase to 90 degrees in a clockwise direction with respect to the conveying member 141*c*. The conveying member 141*k* puts the phase to 90 degrees in a clockwise direction with respect to the conveying member 141*y*. The conveying member 141*m* puts the phase to 90 degrees in a clockwise direction with respect to the conveying member 141*k*.

The switching device 174 is switched based on a switch timing signal Ts from the control unit 171. The switch timing signal Ts is output from the control unit 171 to the switching device 174 when the control unit 171 determines that angles against the detecting surface 150*a* of the four conveying members 141*m*, 141*c*, 141*y*, and 141*k* have become a preliminarily set angle (a setting angle). The determinations that these angles have become the setting angle are performed based on an output of the rotation angle sensor 172 input to the control unit 171.

Specifically, when the control unit 171 determines that any of the angles of the four conveying members 141*m*, 141*c*, 141*y*, and 141*k* is positioned at the proximity of the state S1 in FIG. 5, the control unit 171 connects to an output signal of an object determined among the density sensors 150*m*, 150*c*, 150*y*, and 150*k*. The control unit 171 is constituted of a CPU (not illustrated). The density sensors 150*m*, 150*c*, 150*y*, and 150*k* have output signals that are input to a digital port (not illustrated) of the CPU as pulses. The control unit 171 detects the toner density as the number of pulses per unit time.

Thus, the toner density detecting system of the embodiment can detect angles of the four conveying members 141*m*, 141*c*, 141*y*, and 141*k* by the single rotation angle sensor 172 and also perform processing by one digital port of the CPU. Since the four conveying members 141*m*, 141*c*, 141*y*, and 141*k* rotate at the phase differences preliminarily known, the detection of any one angle of them ensures detections of all angles. Thus, the toner density detecting system of the embodiment can detect remaining amounts of the developers of the four colors by the reduced hardware.

The disclosure can be performed not only in the above-described embodiment, but also in following modifications.

Modification 1

While in the above-described embodiment, the remaining amounts of the developers of the four colors are detected, the disclosure can be applied as long as N number of colors. N is an integer equal to or greater than two.

Modification 2

While in the above-described embodiment, the conveying member includes a scraper, the stirring/conveying member does not necessarily include the scraper and only have to include a stirring portion that changes a developer state at a constant cycle at the detecting region. However, including the scraper can reduce the misdetections (the errors) due to the accumulation of the developer (for example, attachment or deposition to a detecting surface) at the detecting region.

Modification 3

While in the above-described embodiment, a switching device switches an output to a control unit based on the angle measured by a rotation angle sensor, the switching device does not necessarily use the rotation angle sensor. The switching device may detect the lowest-frequency phase for one angle of a plurality of stirring portions and switch based on preliminarily set phase differences also for the other stirring portions. The switching device is also referred to as a switching unit.

Modification 4

While in the above-described embodiment, the plurality of stirring portions are configured to synchronously rotate at the preliminarily set phase differences, the plurality of detecting region stirring portions does not necessarily have phase differences and may have identical phase differences. However, while when having the identical phase differences, one-color detection is performed at one rotation, the above-described embodiment has an advantage that all-color detection can be realized at one rotation.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developing section comprising:

N (N is an integer equal to or greater than two) number of containers that each house a developer including a toner;

N number of conveying members that stir and convey the respective developers inside the N number of containers;

N number of first sensors located at the N number of containers each to detect a developer remaining amount inside a respective one of the N number of containers;

stirring portions located at the respective N number of conveying members to stir the developers at detecting regions opposed to detecting surfaces of the N number of first sensors by rotations of the N number of conveying members;

a switching unit that selects any one of outputs of the N number of first sensors to output; and a control unit that receives the selected output to detect a respective one of the remaining amounts of the developers inside the N number of containers, wherein the N number of conveying members synchronously rotate at preliminarily set phase differences, and the switching unit selects the output of the first sensor corresponding to the conveying member at an angle against the detecting surface that has become a preliminarily set angle.

2. The developing section according to claim 1, further comprising:

a second sensor that measures the angle against the detecting surface.

3. The developing section according to claim 1, wherein the control unit receives the selected output as a pulse to perform the detection based on a count of the pulses received within a preliminarily set period.

4. The developing section according to claim 1, wherein each of the stirring portions comprises a scraper that slides across the detecting surface while the conveying member rotates.

5. An image forming apparatus comprising the developing section according to claim 1.

* * * * *